US009558633B2

(12) United States Patent
Watkins

(10) Patent No.: US 9,558,633 B2
(45) Date of Patent: Jan. 31, 2017

(54) SLOT MACHINE GAME WITH MYSTERY BONUS FEATURE USING MIXED MATH

(71) Applicant: EVERI GAMES INC., Austin, TX (US)

(72) Inventor: Brian Alexander Watkins, Austin, TX (US)

(73) Assignee: Everi Games Inc., Austin, TX (US)

( * ) Notice: Subject to any disclaimer, the term of this patent is extended or adjusted under 35 U.S.C. 154(b) by 243 days.

(21) Appl. No.: 13/954,366

(22) Filed: Jul. 30, 2013

(65) Prior Publication Data

US 2015/0038212 A1 Feb. 5, 2015

(51) Int. Cl.
*G07F 17/34* (2006.01)
*G07F 17/32* (2006.01)

(52) U.S. Cl.
CPC ..... *G07F 17/34* (2013.01); *G07F 17/3239* (2013.01); *G07F 17/3244* (2013.01); *G07F 17/3267* (2013.01)

(58) Field of Classification Search
CPC ..... G07F 17/34; G07F 17/32
See application file for complete search history.

(56) References Cited

U.S. PATENT DOCUMENTS

| | | | | |
|---|---|---|---|---|
| 6,203,429 | B1 | 3/2001 | DeMar et al. | |
| 7,066,814 | B2 | 6/2006 | Glavich et al. | |
| 7,530,892 | B2 * | 5/2009 | Jordan et al. | 463/20 |
| 7,789,744 | B2 | 9/2010 | Fiden | |
| 8,317,587 | B2 | 11/2012 | Gomez et al. | |
| 8,317,588 | B2 | 11/2012 | Kroeckel et al. | |
| 2010/0048293 | A1 | 2/2010 | Hornik | |

OTHER PUBLICATIONS

Gaming Devices in Casinos, Standard Series, Jun. 30, 2006, No. 11, ver. 1.4, Gaming Laboratories International, Inc.

* cited by examiner

*Primary Examiner* — Jason Skaarup
*Assistant Examiner* — Alex F. R. P. Rada, II
(74) *Attorney, Agent, or Firm* — Nathan Calvert, Esq.; Russell D. Culbertson, Esq.; JP Cody, Esq.

(57) ABSTRACT

Provided is a mixed-math slot machine game having a reels-first base game and a mystery bonus feature with prize-first game logic. After any winning play of the base game, the reels have the possibility of re-spinning a number of times, with the preferred version varying the re-spins from one to four times, for example. If this happens, the game screen informs the player that he or she has been awarded the bonus. While this bonus is triggered by the first base game spin of the reels, the possible prizes it awards are statistically weighted based on the amount of the initial base game prize from the winning reel stop. Various ways of implementing the change of gaming logic are provided.

19 Claims, 8 Drawing Sheets

SLOT MACHINE GAME WITH MYSTERY BONUS FEATURE USING MIXED MATH

TECHNICAL FIELD OF THE INVENTION

This invention relates to gaming systems and to gaming machines through which players may participate in wagering games. More particularly, the invention relates to methods for conducting a base game and bonus game having different mathematical processes, integrated to provide a seamless game experience.

BACKGROUND OF THE INVENTION

Various slot machine games since the 1970's have used simulated reels to conduct a slot machine game in which the reels are spun and stopped, and the results evaluated according to a paytable. Spinning mechanical reels being subject to error and non-random deviation, machines were developed in which each reel is controlled by a random number generator, the generator determining the stop position of the reel. A game controlled by random numbers in such a manner is called "reels-first" or "reels-first math," referring to the mathematics of executing the game rules being based on the reels. Another method developed years later is known as "prize-first." This method allows the use of lottery tickets, game outcome pools, central outcome servers, and other modern techniques to ensure that the payout of a game is randomly distributed and has the desired distribution of prizes. The term prize-first refers to the fact that the prize is known when the outcome is randomly generated or selected, and then the reels are controlled to spin and stop to provide a pattern that evaluates on the game's paytable to produce the desired prize. However, for various reasons, many gaming regulatory jurisdictions require the reels-first design to be used. Such a requirement complicates the use of bonus rounds and makes game design more difficult when complicated bonus features are desired.

SUMMARY OF THE INVENTION

The present invention provides a mystery bonus feature on a base game that has reels-first game logic. The mystery bonus feature has prize-first game logic, and is provided as a mystery feature triggered without any indication to the player, unlike a standard bonus feature that is triggered by a particular reel stop. This creates an element of surprise and suspense for the player, as any winning play could potentially feature a free spin bonus round that adds to the win amount. After any winning play, the free spin bonus round may occur in which the reels have the possibility of re-spinning a number of times, with the preferred version varying the re-spins from one to four times. If this happens, the game screen informs the player that he or she has been awarded the bonus. Distinctive sound effects then play while the reels re-spin. While this bonus is triggered by the first base game spin of the reels, the possible prizes it awards are statistically weighted based on the amount of the initial base game prize from the winning reel stop. In this way, the invention provides an exciting and random bonus feature that is nonetheless statistically predictable and occurs within proper payout percentages.

Another version of the invention is a computer program stored on a non-transitory readable medium. The software version is, of course, typically designed to be executed by a gaming machine or networked gaming system. The software includes multiple portions of computer executable code referred to as program code. Gaming results are provided in response to a wager and displayed by display program code that generates simulated slot reels each including one or more symbol locations. Reels-first program code is used in the base game to link random number generators to control the simulated reels. However, the bonus round is conducted with prize-first program code controlling the display of already selected bonus prizes.

Another version of the invention is a gaming system that includes one or more gaming servers, and a group of electronic gaming machines connected to the servers by a network. The various functionality described herein may be distributed between the electronic gaming machines and the gaming servers in any practically functional way. For example, the current preferred architecture is for the servers to determine all aspects of game logic, random number generation, and prize awards. However, the reels-first game implementation may interface with hardware or software random number generators present on the gaming machine. The gaming machines provide functionality of interfacing with the player and animating the game's presentation of the results received from the server in an entertaining manner. However, other embodiments, of course, might use a thin client architecture in which the animation is also conducted by the server and electronic gaming machines serve merely as a terminal to receive button or touch screen input from the player and to display graphics received from the server. Some systems may also employ an ultra-thin architecture, in which the gaming machine does not run a full operating system, and instead only sends inputs and displays video received from the server.

Different features may be included in different versions of the invention. For example, the prize-first bonus game may include display scripts for presenting the total bonus prize as multiple free spins, or may use random numbers to divide up the bonus prize and then use prize-first control logic to present each partial prize as a free spin.

These and other advantages and features of the invention will be apparent from the following description of the preferred embodiments, considered along with the accompanying drawings.

DETAILED DESCRIPTION OF PREFERRED EMBODIMENTS

Figure 1:
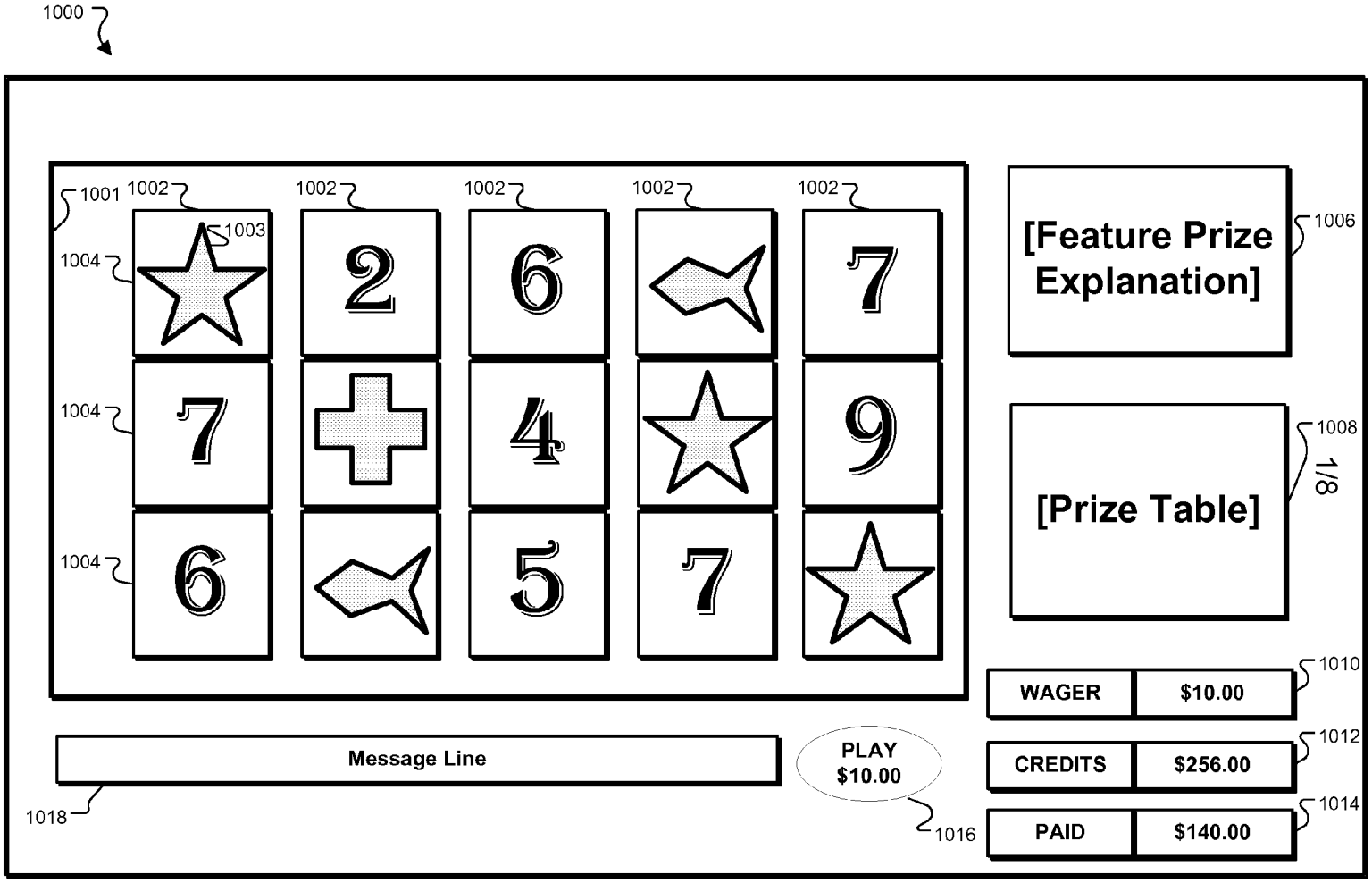
FIG. 1 is a game screen diagram of a base game screen according to one embodiment, including multiple simulated reels.

FIG. 1 is a screenshot diagram showing the game play area of an example game employing the mixed-math control feature described herein. The gaming area is represented as a matrix 1001 of symbol locations arranged in rows and columns to represent simulated slot machine reels that are spun to conduct a game. Other embodiments may, of course, use other types of game displays to display randomizing of symbols according to the methods herein. The depicted columns of symbols labeled 1002 represent the simulated reels, while symbols are designated 1004. In this instance, there are five reels with three symbol locations 1004 displayed on the perimeter of the reel, but the game can be played with more or less reels. The simulated reel typically has far more symbols than those displayed and as many unique stop positions as there are symbols on the simulated reel. The stop position may be counted, for example, by numbering the symbols on the simulated reel and using the number of the symbol at the bottom of the display window (the three symbols displayed in this example), or at the top or middle. Further, while multi-symbol reels are shown, other versions may use simulated uni-symbol reels, or a reel that has many symbols thereon but only a single window to the reel being simulated, displaying a single symbol from the reel. Some variations of the present invention may use a simulated uni-symbol reel in each depicted symbol location 1004.

On the right in box 1006 are the instructions for playing the game. Underneath the instructions, a prize table is shown in box 1008, as are the prizes that can be won and the requirements for winning. Winning patterns are typically formed by matching symbols along defined paylines that pass through the matrix 1001. Under box 1008 is box 1010, which displays the current wager. Under box 1010 is box 1012, which displays any credits in the player's account. Under box 1012 is box 1014, which displays the player's last awarded winnings. To the left of box 1014 in the touchscreen display button component 1016, is the price of the base game play. In the bottom left-hand corner there is a message line 1018, where the game station can display further instructions to the player.

Figure 2A:
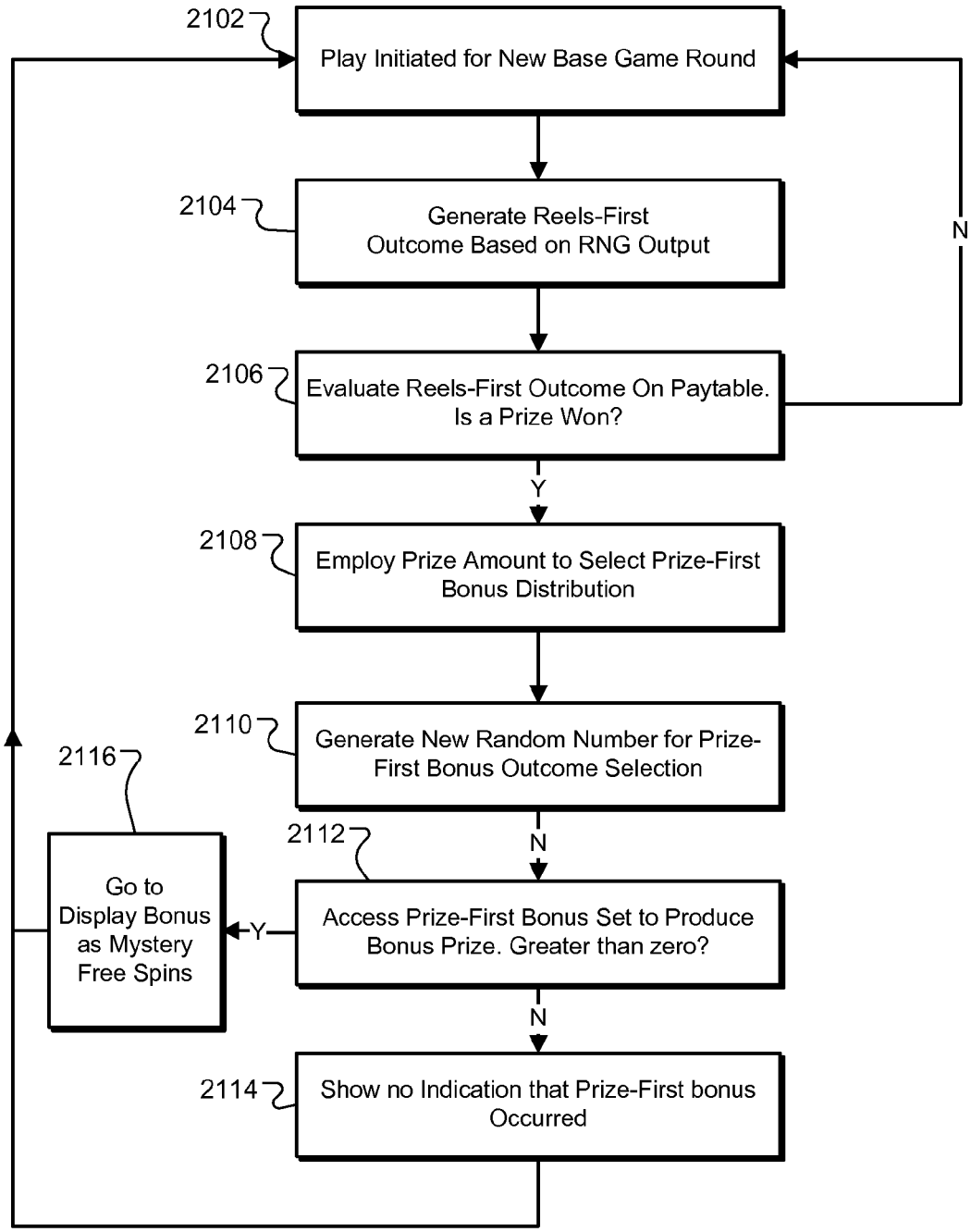
FIG. 2A is a flow chart showing an example game play process at a gaming machine that includes a mixed math scheme using reels-first game logic, and then prize-first game logic according to one or more embodiments.

FIG. 2A is a flow chart showing an example game play process at a gaming machine that includes a mixed math scheme using reels-first game logic, and then prize-first game logic according to one or more embodiments. As an overview of the depicted process, game titles employing this process will generally produce a reels-first game outcome (step 2104) by linking a random number generator (RNG) output to each simulated reel in the base game. For winning base game outcomes, an additional random number selection is made to conduct the prize-first bonus game by producing an outcome from a separate statistical database. For each possible base game prize amount, this database contains a separate set of possible bonus prizes with different statistical weights (step 2108). Each set of possible prizes contains a prize of zero credits, which carries a high probability of being drawn. Thus, every winning play in a base game title is awarded an additional prize—but most often this second prize is zero credits. The prize-first amount determined by the additional number selection will be awarded to the player during the bonus, which is preferably conducted as a free spin bonus round having one or more re-spins of the reels. Note that in the preferred version described herein, the free spin bonus round is provided as a mystery feature with no further player activation required. Other versions may provide a bonus round requiring player activation. Zero-credit wins in the base game do not trigger a re-spin animation, so the bonus appears to occur intermittently. The probability of winning a non-zero prize amount in the bonus is based on the size of the initial base game win. This is factored in to the mathematical probability model for the game title. Therefore, gaming titles with this feature are able to operate within predictable hold percentages.

Figure 2B:
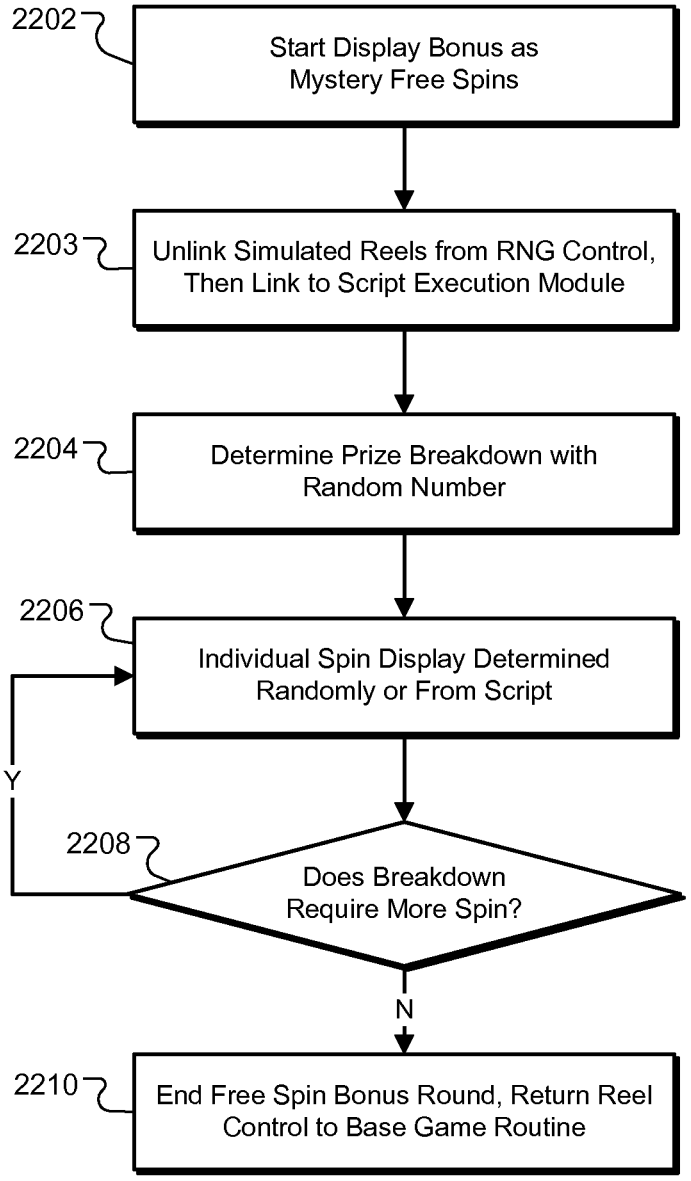
FIG. 2B is a flow chart of a bonus game display sequence showing further detail as to how prize-first game logic is implemented according to one or more embodiments.

FIG. 2B is a flow chart of a bonus game display sequence showing further detail as to how prize-first game logic is implemented according to one or more embodiments.

Figure 2C:
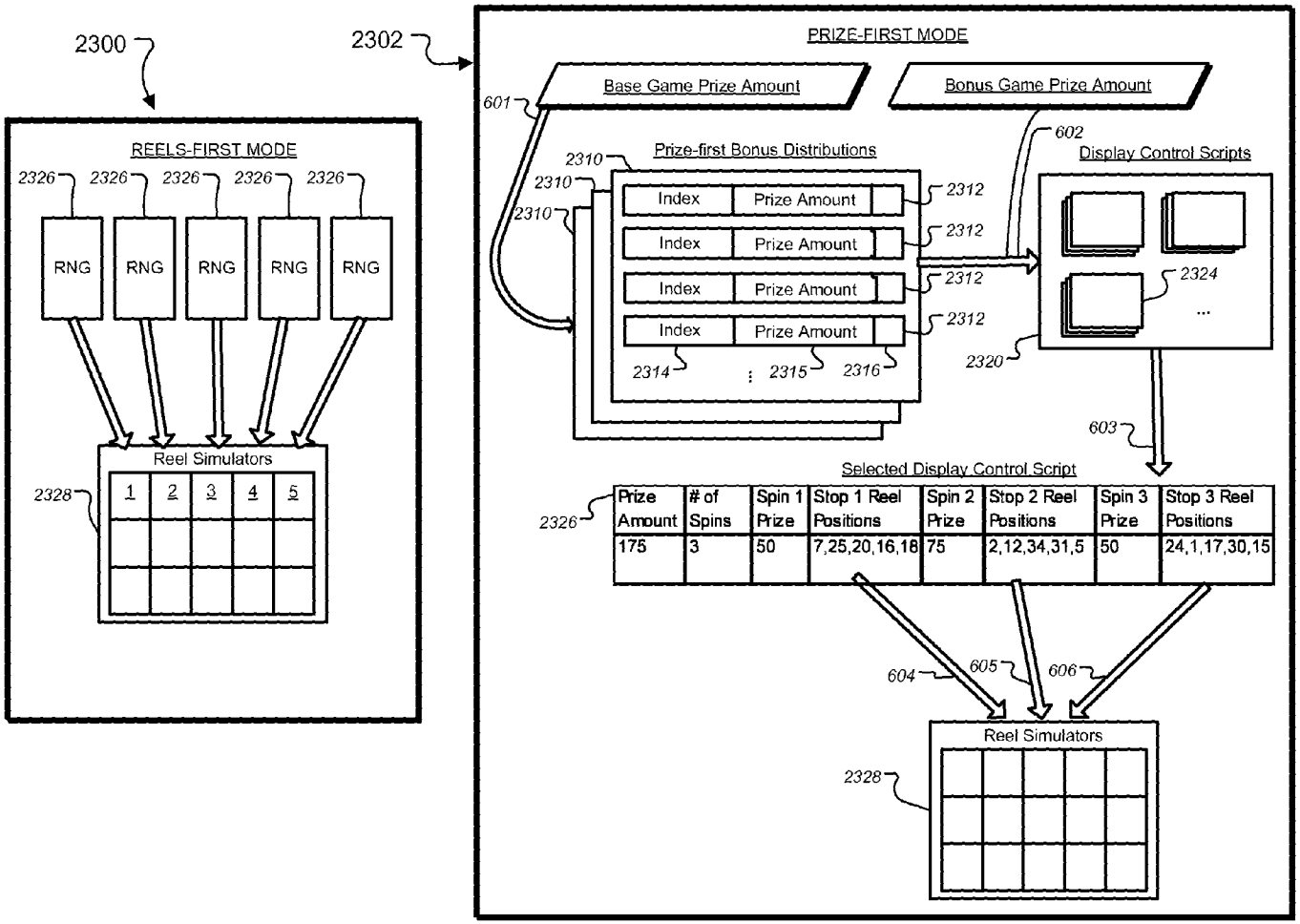
FIG. 2C shows a sequence of data structures and program code modules that may be used to switch control modes according to one or more embodiments.

FIG. 2C shows a sequence of data structures and program code modules that may be used to switch control modes according to one or more embodiments. The depicted data structures are used to generate results, display results, and track bonus tickets and multipliers awarded in the base game. This is merely one example implementation, and one of skill in the art will understand from the remaining disclosure that many other implementations are possible to achieve similar results.

Figure 3A:
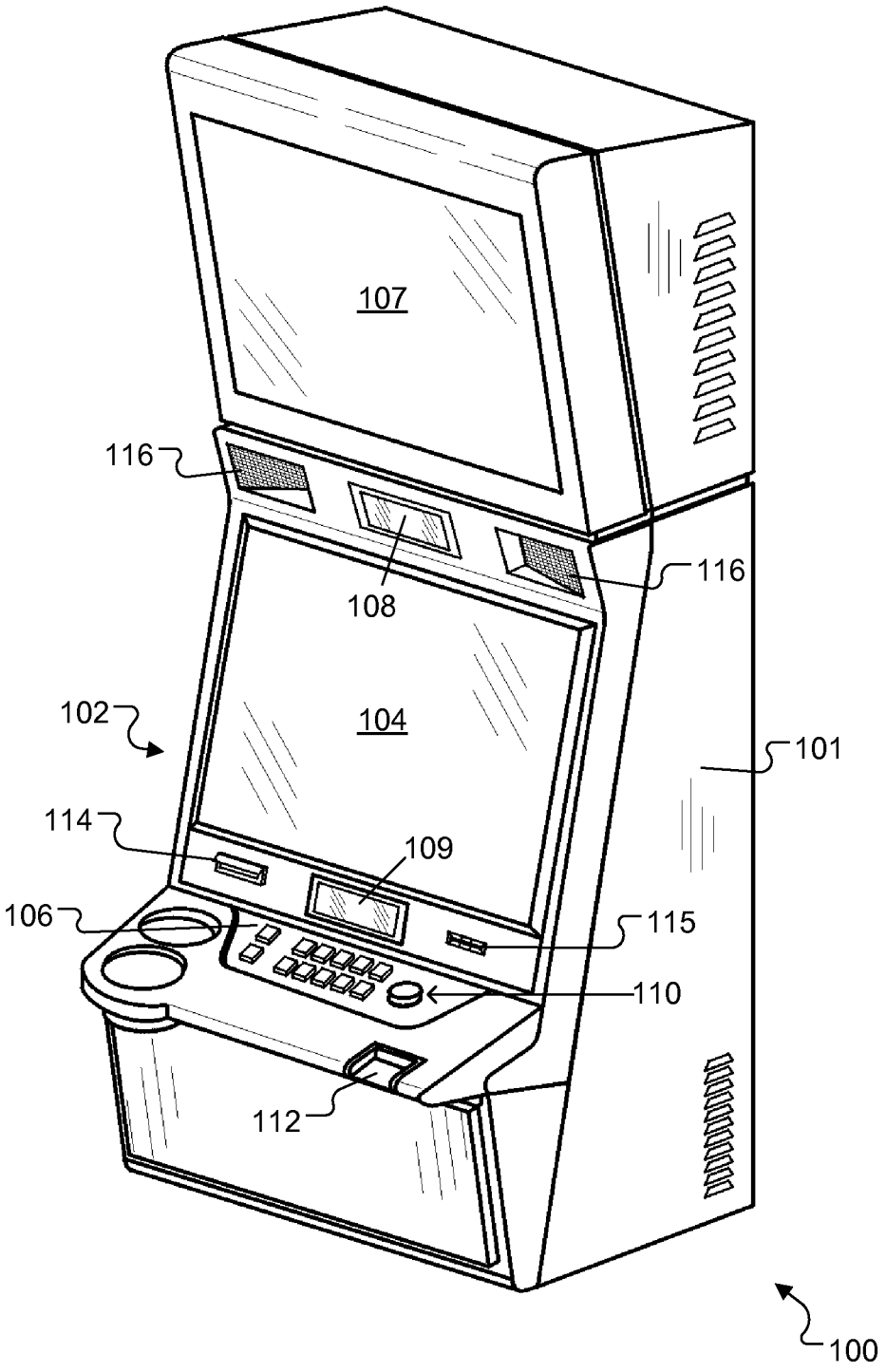
FIG. 3A is a front perspective view of a gaming machine which may be used in a gaming system embodying the principles of the present invention.

Referring now to the flow chart of FIG. 2A, and making reference to the other figures as necessary, at step 2102 the base game play is initiated by the player placing a wager through the touch interface in FIG. 1 or the related hardware buttons on the gaming cabinet (FIG. 3A). In response to this game initiation, the process at step 2104 generates a reels-first outcome based on the output of one or more RNGs. At this point, the game is operating in the reels-first mode shown in FIG. 2C, in which a random number generation is linked to each of the simulated reels. Some versions may employ a separate hardware or software RNG for each reel, while others may use one approved RNG to produce all the random numbers needed for this step. A single RNG is preferred for simplicity, but gaming legal regulations may require multiple RNGs. What is important is that the RNG output is linked to each of the simulated reels in each step such that the final reel position is determined randomly to produce a reels-first outcome. This outcome is evaluated at step 2106 using the game's paytable to determine if a prize is won based on one or more winning patterns achieved. If no prize is won, the process returns to step 2102 and waits for a new game initiation with a new wager.

If a prize is won at step 2106, the process goes to step 2108 where it employs the amount of the prize (determined by the game's paytable) to select a prize-first bonus distribution to employ in the bonus round logic. Step 2108 preferably occurs every time a prize is won in the base game. Selecting a prize-first bonus distribution is depicted in FIG. 2C where the base game prize amount is employed at the process arrow labeled "601" to select from among a group of multiple prize-first bonus distributions 2310. Preferably, the group contains one bonus distribution 2310 for each possible prize value in the base game. Each bonus distribution contains a set of bonus outcomes having all the possible bonus prize values that could be provided for the associated base game prize value. After selecting the prize-first bonus distribution, the process goes to step 2110 where it generates a new random number to produce the bonus outcome. Note that this random number is not linked directly to a reel simulator and may be produced from a different hardware or software RNG than those used in the base game round, or it may be produced from the same RNG.

The process next uses the generated random number to access the selected prize-first bonus distribution ("bonus set") to produce a bonus outcome with a bonus prize amount (Step 2112). The bonus outcome may have a zero prize amount as discussed above. The method of producing the outcome from a prize-first bonus distribution 2310 may vary, but what is important is that the outcome is randomly selected out of the distribution, and that the distribution contains a set of outcomes with prize amounts, the outcomes having a desired statistical distribution as determined to match with the associated base game prize amount to produce a desired game payout percentage. The actual structure of prize-first bonus distributions may be implemented in a number of ways, with different data content in the prize-first distribution's data structure 2310, as described further with respect to FIG. 2C. Step 2112 employs the random number to either look up or otherwise produce or select a specific entry or outcome out of the prize-first bonus distribution. This outcome has a prize value that may be zero or a positive bonus prize value. If the bonus prize value is greater than zero, the process goes from step 2112 to step 2116, where it goes to the routine to display the bonus prize as a mystery prize with free spins (FIG. 2B, for example). If the prize-first bonus prize value is zero back at step 2112, the process goes to step 2114, where it shows no indication on the game screen or reels that the prize-first bonus evaluation in the previous two steps has occurred, and then returns to step 2102 to wait for a new game activation. Step 2114 allows the use of prize-first math for a bonus round, while still maintaining the mystery prize effect and also allowing the game to not display the start of a bonus round if the bonus prize will be zero. The use of this technique allows the prize-first math feature to be employed with a reels-first base game and provide a smooth presentation to the client without showing many disappointing, zero value bonus outcomes.

Referring now to FIG. 2B, this figure is a flow chart of a bonus game display sequence according to one or more embodiments, which process would be accessed at step 2116 of FIG. 2A. In preferred versions, the prize-first bonus round is conducted as a free-spin mystery bonus (with the term "mystery" having its customary meaning in the gaming industry that the feature occurs without an indication to the player as to why it was triggered in the game). The process in FIG. 2B occurs when a prize-first bonus prize needs to be presented to the player, which occurs in this version on the same reel simulators used to present the base game. However, because the bonus prize is not reels-first, at step 2203 the reel simulators are unlinked from control by RNG values, and linked to control by a script execution module or other prize-first display control module. Such a display control module implements the spinning of the reels to display a desired prize value that has already been determined. The breakdown can include multiple steps or a single step in which the entire bonus prize is won in a single spin of the reels.

The specific implementation of step 2203 and the prize-first game logic may be done in a variety of ways. To keep the presentation of this award amount unpredictable and exciting, some versions will select a further sequence of random numbers which are used to determine how to display the prize-first award determined at step 2204. These extra random number selections have no effect on any prize awards or hold percentages. Other versions will randomly select a suitable display sequence from a set of display control scripts to control the simulated reels to spin and stop a plurality of times according to data in the display control script, each stop providing a portion of the bonus game prize amount as a prize. In such versions, the breakdown of the prize and the display of each portion is determined by the script, as further described with respect to FIG. 2C. In either case, the process displays individual spins from one or more portions of the prize breakdown at step 2206. If there are further spins to be shown, the process at step 2208 returns to 2206 to conduct another re-spin. Finally, at step 2210 once the last re-spin has been completed and the last portion of prize breakdown has been awarded, the process ends the free spin bonus round and returns the reels control to the reels-first game logic to await a further game activation in the base game.

Referring now to FIG. 2C, this figure shows a block diagram of software modules and data structures for the two different modes in which the game may operate. The change of modes is done when the games simulated reels are changed to a different mode (step 2203 and change back in step 2210 in FIG. 2B). The depicted reels-first mode 2300 is used in the base game. This mode is implemented, as described above, with a separate random number generator 2326 controlling the reel stop location for each reel 2328 (numbered 1-5 in this version) when the reels stop spinning in the base game. The game logic then evaluates the locations according to the paytable. Each separate random number generation may be from a separate RNG module, or a single RNG module may produce all random numbers (five in the depicted version). Preferably a single RNG module is used.

Referring now to the prize-first mode 2302, this mode provides for prize-first game logic to be employed to control the same reels 2328 used in the base game reels-first round. Although the use of prize-first logic refers generally to generating the bonus game prize amount before the bonus game prize display, this prize-first mode also uses the base game prize amount in the game logic. The base game prize amount is employed at the process arrow labeled "601" to select from among a group of multiple prize-first bonus distributions 2310. Preferably, the group contains one bonus distribution 2310 for each possible prize value in the base game. Each bonus distribution contains a set of bonus outcomes having all the possible bonus prize values that could be provided for the associated base game prize value.

The prize-first bonus distributions may be implemented in a number of ways, with different data content in the prize-first distribution's data structure 2310. Regardless of the implementation, typically the bonus prize generation follows one of two processes. In the first process, the base game prize amount is used to index a table and lookup an outcome in the table. In such a version, the outcomes are stored in a table in bonus distribution data structure 2310 which is indexed by the random number to provide suitable distributed, randomly-selected results. The lookup table has a number of outcome entries 2312, each with an index 2314, and a prize amount 2315 in credits. The outcome entry 2312 may have other data fields 2316 to control or track other parts of the game. For example, each entry 2312 may be pre-linked to a display control script or set of display control data.

The second general way the bonus distributions can be implemented is as a set or pool of individual outcome records, all predefined with a prize amount. The data structure for a record would generally have the same structure as in a table implementation, but may have further fields for tracking the record through deployment and activation. Referring to a bonus game distribution 2310, in this implementation the data structure itself may be stored at a game server and accessed with requests from the gaming machine, or the server may allocate groups of outcome records to be stored and used locally at a gaming machine. An outcome record or entry 2312 is chosen from the pool either randomly or from a randomly-organized queue.

The preferred process to display prize-first bonus results is as follows. The simulated reels are placed under control of a bonus display module such as a script execution module (step 2203) if the bonus prize selected prize-first distribution is non-zero. If a display script system is used, to start updating the reel display, the process uses the prize amount field 2315 to select a display control script from a group of scripts 2324. This step is indicated by the arrow labeled "602." The selection process at arrow 602 may be made in any suitable manner that selects a display control script to display the bonus outcome based on the outcome record. The selected script is used to control the display to provide an exciting series of events in the free-spin bonus round. A preferred control sequence proceeds as follows. The gaming machine presentation controller uses the prize amount 2315 to select a set 2324 of display control scripts from the script group 2320. The group 2320 has multiple sets. The selected set 2324 includes, in this example version, all display control scripts that have a total prize outcome equal to the prize amount 2315. The set 2324 preferably includes many display control scripts with each one using a different set of reel positions to indicate the total prize amount (assuming a reel-type game is the game used—however, any suitable type of game may be used). This helps provide variety and excitement to the game. For example, suppose the selected game outcome entry or record 2312 indicates a 125-credit prize. The display controller looks to the group of display control scripts 2320 and finds the set of scripts 2324 that all have a total prize value of 125 credits. The display controller then randomly selects from this set, preferably by generating a random number and using it as an index to identify a particular script. Any suitable random selection or randomization step may be used, or a predetermined sequence may also be used if it is long enough that no pattern is discernable during player use of the gaming machine. In any event, a single display control script 2326 is chosen from the set 2324 for use in displaying the base game results to the player. This is indicated by the arrow marked "603."

A display control script 2326 chosen at arrow 603 for the free spin bonus round includes, in this version, the depicted data fields shown in the example display control script 2326. The fields are shown with field name on top and an example value on bottom. Other fields may also be included, and some fields are not absolutely necessary. This version includes the total prize field in the display control script for tracking purposes. The script 2326 contains a reel position field for each reel in the reel-type base game display. These fields indicate the final positions of the reels needed to convey the desired game outcome. In some versions, a Frequency field (not shown) indicates a number indicating the hit frequency or probability that this particular script will be selected from the set 2324. For example, a 0.05 Frequency value would indicate that this script will be shown 5% of the time and a total bonus prize of 175 is awarded. This hit frequency is preferably controlled through selection by an evenly-distributed random number, but may be enforced by other suitable methods, including random number based methods or methods that rigidly enforce the hit frequency.

The presentation controller employs the script 2326 to control the stop positions of a simulated reel spin. This is designated by the arrow marked "604," which points to the reel simulator 2328. The simulator 2328 simulates spinning slot-machine reels and displays resulting symbols. Each simulated reel is modeled as a set of reel-symbols arranged in a circle. In some games, as mentioned above, uni-symbol reels are used with one symbol from each simulated reel shown at a time, and other games may use multi-symbol reels, such as a 3 or 5 symbol reel. The simulated reels are controlled by their position, which is designated by which symbol placed on the reel is presented at the center space in the three vertical symbol spaces shown in the 5 reels. The reel stop data is part of script 2326 and contains a reel stop position for each reel in the simulated reel display. Various scripts contain different numbers of spins, providing different prize breakdowns for the total prize amount. The example script has three spins, but preferably anywhere from one to five spins are used, although this is not limiting and more may be used.

As described above with regard to FIG. 2B, the prize-first free-spin bonus prize may also be displayed with a spin breakdown controlled by random numbers generated during the bonus round. In such case, the display proceeds as described above, but reel stop data is randomly selected to display each prize portion in the breakdown. For example, if the random breakdown produced the game prize amounts for Spin 1-Spin 3 as shown in script 2326, spin 1 would be conducted by using a random number to select from the set of display control scripts or reel-stop data sets that produce a prize of 50 credits. In this embodiment, each spin proceeds accordingly as described with regard to FIG. 2B, until the entire bonus prize is awarded.

Figure 3B:
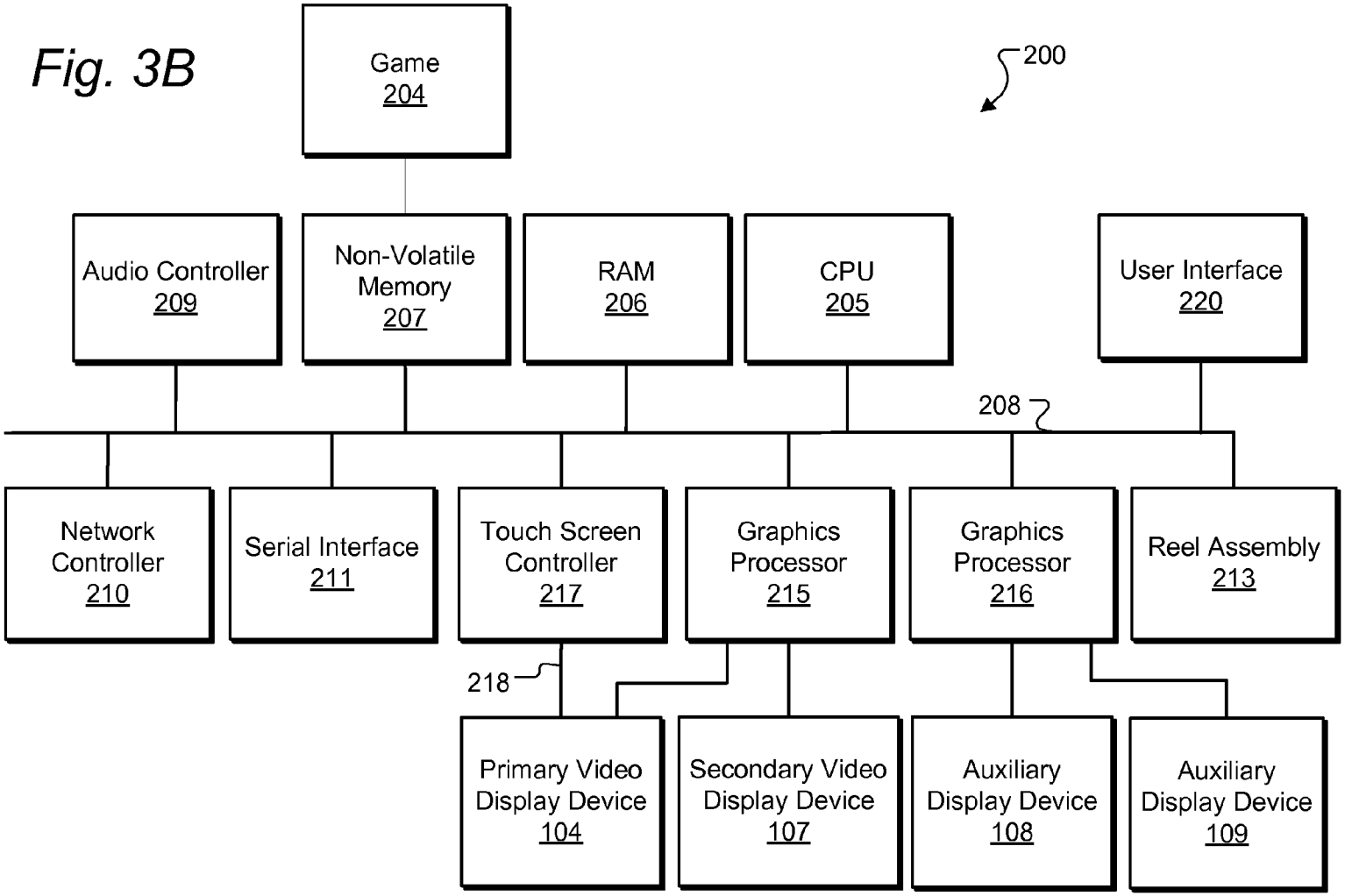
FIG. 3B is a block diagram showing various electronic components of the gaming machine shown in FIG. 3A, together with additional gaming system components.

FIG. 3A shows a gaming machine 100 that may be used to implement a prize-first bonus round according to the present invention. The block diagram of FIG. 3B shows further details of gaming machine 100. Referring to FIG. 3A, gaming machine 100 includes a cabinet 101 having a front side generally shown at reference numeral 102. A primary video display device 104 is mounted in a central portion of the front surface 102, with a ledge 106 positioned below the primary video display device and projecting forwardly from the plane of the primary video display device. In addition to primary video display device 104, the illustrated gaming machine 100 includes a secondary video display device 107 positioned above the primary video display device 104. Gaming machine 100 also includes two additional smaller auxiliary display devices, an upper auxiliary display device 108, and a lower auxiliary display device 109. It should also be noted that each display device referenced herein may include any suitable display device including a cathode ray tube, liquid crystal display, plasma display, LED display, or any other type of display device currently known or that may be developed in the future.

In preferred versions, the gaming machine 100 illustrated in FIG. 3A also includes a number of mechanical control buttons 110 mounted on ledge 106. These control buttons 110 may allow a player to select a bet level, select pay lines, select a type of game or game feature, and actually start a play in a primary game. Other forms of gaming machines according to the invention may include switches, joysticks, or other mechanical input devices, and/or virtual buttons and other controls implemented on a suitable touch screen video display. For example, primary video display device 104 in gaming machine 100 provides a convenient display device for implementing touch screen controls.

It will be appreciated that gaming machines may also include a number of other player interface devices in addition to devices that are considered player controls for use in playing a particular game. Gaming machine 100 also includes a currency/voucher acceptor having an input ramp 112, a player card reader having a player card input 114, and a voucher/receipt printer having a voucher/receipt output 115. Audio speakers 116 generate an audio output to enhance the user's playing experience. Numerous other types of devices may be included in gaming machines that may be used according to the present invention.

FIG. 3B shows a logical and hardware block diagram 200 of gaming machine 100 which includes a central processing unit (CPU) 205 along with random access memory 206 and nonvolatile memory or storage device 207. All of these devices are connected on a system bus 208 with an audio interface device 209, a network controller 210, and a serial interface 211. A graphics processor 215 is also connected on bus 208 and is connected to drive primary video display device 104 and secondary video display device 107 (both mounted on cabinet 101 as shown in FIG. 3A). A second graphics processor 216 is also connected on bus 208 in this example to drive the auxiliary display devices 108 and 109 also shown in FIG. 3A. As shown in FIG. 3B, gaming machine 100 also includes a touch screen controller 217 connected to system bus 208. Touch screen controller 217 is also connected via signal path 218 to receive signals from a touch screen element associated with primary video display device 104. It will be appreciated that the touch screen element itself typically comprises a thin film that is secured over the display surface of primary video display device 104. The touch screen element itself is not illustrated or referenced separately in the figures.

Those familiar with data processing devices and systems will appreciate that other basic electronic components will be included in gaming machine 100 such as a power supply, cooling systems for the various system components, audio amplifiers, and other devices that are common in gaming machines. These additional devices are omitted from the drawings so as not to obscure the present invention in unnecessary detail.

All of the elements 205, 206, 207, 208, 209, 210, and 211 shown in FIG. 3B are elements commonly associated with a personal computer. These elements are preferably mounted on a standard personal computer chassis and housed in a standard personal computer housing which is itself mounted in cabinet 101 shown in FIG. 3A. Alternatively, the various electronic components may be mounted on one or more circuit boards housed within cabinet 101 without a separate enclosure such as those found in personal computers. Those familiar with data processing systems and the various data processing elements shown in FIG. 3B will appreciate that many variations on this illustrated structure may be used within the scope of the present invention. For example, since serial communications are commonly employed to communicate with a touch screen controller such as touch screen controller 217, the touch screen controller may not be connected on system bus 208, but instead include a serial communications line to serial interface 211, which may be a USB controller or a IEEE 1394 controller for example. It will also be appreciated that some of the devices shown in FIG. 3B as being connected directly on system bus 208 may in fact communicate with the other system components through a suitable expansion bus. Audio interface 209, for example, may be connected to the system via a PCI bus. System bus 208 is shown in FIG. 3B merely to indicate that the various components are connected in some fashion for communication with CPU 205 and is not intended to limit the invention to any particular bus architecture. Numerous other variations in the gaming machine internal structure and system may be used without departing from the principles of the present invention.

It will also be appreciated that graphics processors are also commonly a part of modern computer systems. Although separate graphics processor 215 is shown for controlling primary video display device 104 and secondary video display device 107, and graphics processor 216 is shown for controlling both auxiliary display devices 108 and 109, it will be appreciated that CPU 205 may control all of the display devices directly without any intermediate graphics processor. The invention is not limited to any particular arrangement of processing devices for controlling the video display devices included with gaming machine 100. Also, a gaming machine implementing the present invention is not limited to any particular number of video display devices or other types of display devices.

In the illustrated gaming machine 100, CPU 205 executes software which ultimately controls the entire gaming machine including the receipt of player inputs and the presentation of the graphic symbols displayed according to the invention through the display devices 104, 107, 108, and 109 associated with the gaming machine. As will be discussed further below, CPU 205 either alone or in combination with graphics processor 215 may implement a presentation controller for performing functions associated with a primary game that may be available through the gaming machine and may also implement a game client for directing one or more display devices at the gaming machine to display portions of a prize-first bonus round according to the present invention. CPU 205 also executes software related to communications handled through network controller 210, and software related to various peripheral devices such as those connected to the system through audio interface 209, serial interface 211, and touch screen controller 217. CPU 205 may also execute software to perform accounting functions associated with game play. Random access memory 206 provides memory for use by CPU 205 in executing its various software programs while the nonvolatile memory or storage device 207 may comprise a hard drive or other mass storage device providing storage for programs not in use or for other data generated or used in the course of gaming machine operation. Network controller 210 provides an interface to other components of a gaming system in which gaming machine 100 is included. In particular, network controller 210 provides an interface to a game controller which controls certain aspects of the prize-first bonus round described above.

It should be noted that the invention is not limited to gaming machines employing the personal computer-type arrangement of processing devices and interfaces shown in example gaming machine 100. Other gaming machines through which a prize-first bonus round is implemented may include one or more special purpose processing devices to perform the various processing steps for implementing the present invention. Unlike general purpose processing devices such as CPU 205, these special purpose processing devices may not employ operational program code to direct the various processing steps.

It should also be noted that the invention is not limited to gaming machines including only video display devices for conveying results. It is possible to implement a prize-first bonus round within the scope of the present invention using an electro mechanical arrangement or even a purely mechanical arrangement for displaying the symbols needed to complete the prize-first bonus round as described herein. However, the most preferred forms of the invention utilize one or more video display devices for displaying the spinning reels, the accumulated symbols, and the modifier bonus game. For example, a gaming machine suitable for providing a prize-first bonus round may include a mechanical reel-type display rather than a video-type display device for displaying results in a primary game, and include a video display device for presenting the prize-first bonus round separately.

Still referring to the hardware and logical block diagram 200 showing an example design for a gaming machine 100, the depicted machine in operation is controlled generally by CPU 205 which stores operating programs and data in memory 207 with wagering game 204, user interface 220, network controller 210, audio/visual controllers, and reel assembly 213 (if mechanical reel configuration). CPU or game processor 205 may comprise a conventional microprocessor, such as an Intel Pentium microprocessor, mounted on a printed circuit board with supporting ports, drivers, memory, software, and firmware to communicate with and control gaming machine operations, such as through the execution of coding stored in memory 207 including one or more wagering games 204. Game processor 205 connects to user interface 220 such that a player may enter input information and game processor 205 may respond according to its programming, such as to apply a wager and initiate execution of a game.

Figure 4A:
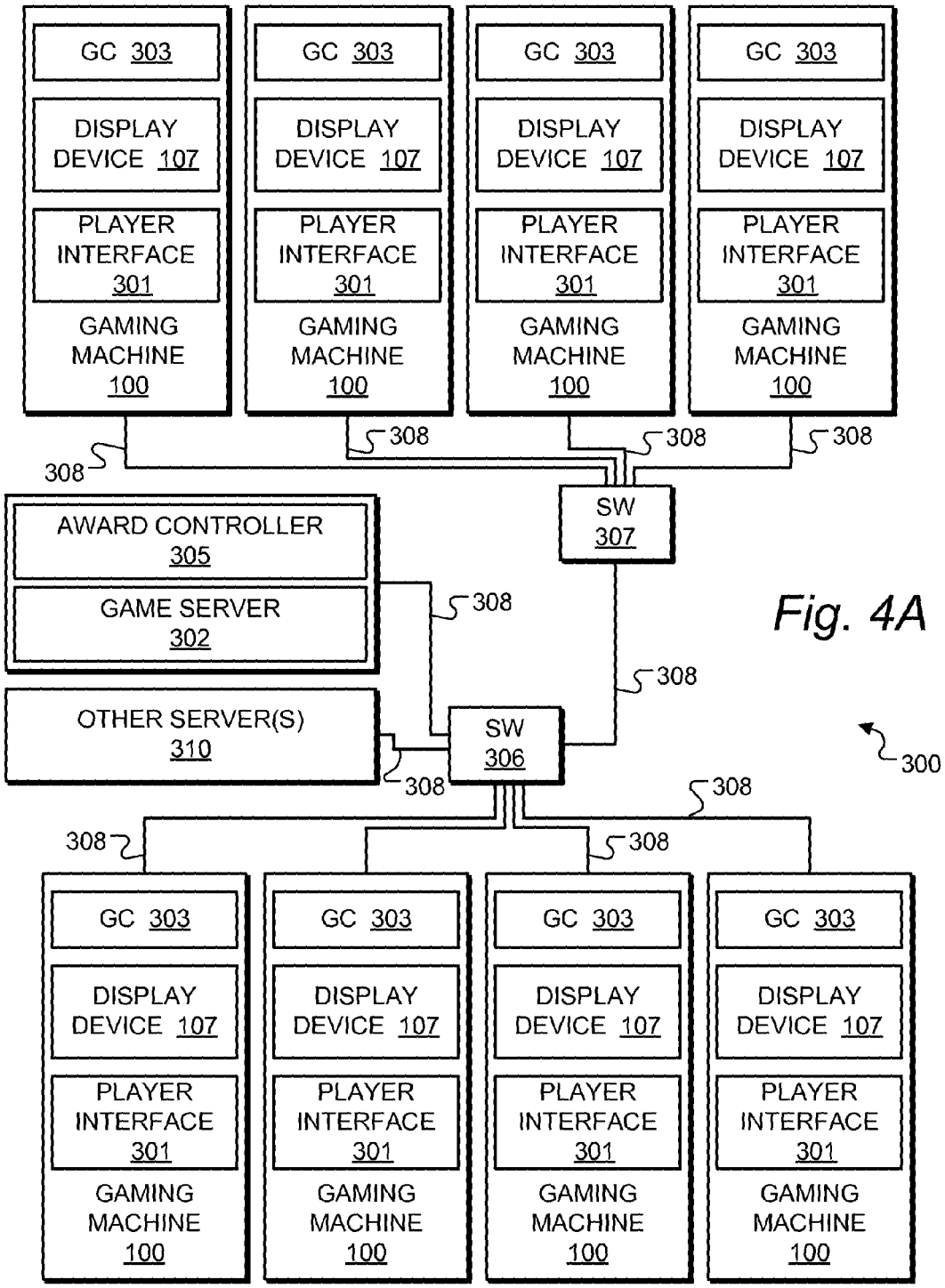
FIG. 4A is a system block diagram of a gaming system according to one embodiment of the present invention.
Figure 4B:
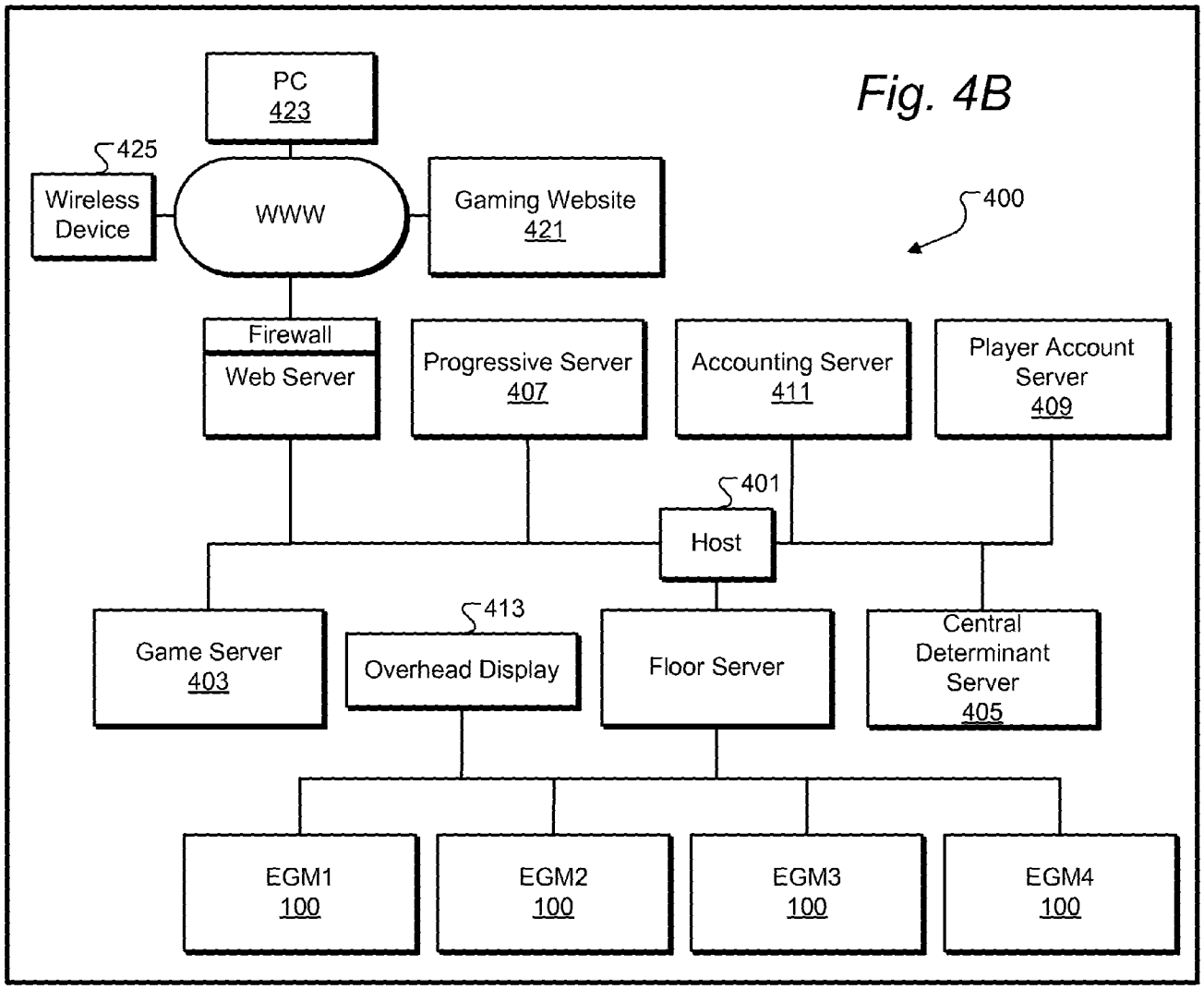
FIG. 4B is a system block diagram of a gaming system according to another embodiment of the present invention.

Game processor 205 also may connect through network controller 210 to a gaming network, such as example casino server network 400 shown in FIG. 4B. Referring now to FIG. 4B, the casino server network 400 may be implemented over one or more site locations and include host server 401, remote game play server 403 (which may be configured to provide game processor functionality including determining game outcomes and providing audio/visual instructions to a remote gaming device), central determination server 405, progressive server 407 (which may be configured to accumulate a progressive pool from a portion of wagering proceeds or operator marketing funds and to award progressive awards upon the occurrence of a progressive award winning event to one or more networked gaming machines 100), player account server 409 (which may be configured to collect and store player information and/or awards and to provide player information to gaming machines 100 after receiving player identification information such as from a player card), and accounting server 411 (which may be configured to receive and store data from networked gaming machines 100 and to use the data to provide reports and analyses to an operator). Through its network connection, gaming machine 100 may be monitored by an operator through one or more servers such as to assure proper operation, and, data and information may be shared between gaming machine 100 and respective servers in the network such as to accumulate or provide player promotional value, to provide server-based games, or to pay server-based awards.

Referring now to FIG. 4A, a gaming system 300 according to another embodiment of the present invention is shown again in a network and system diagram format. System 300 includes a number of gaming machines, each comprising a gaming machine 100 in this example implementation. For purposes of describing system 300, each gaming machine 100 in FIG. 4A is shown as including a video display device 107 and a player interface 301 that may include buttons, switches, or other physical controls and/or touch screen controls as discussed above in connection with FIG. 4A. System 300 further includes a game server 302 and a respective game client 303 (abbreviated "GC" in FIG. 4A) included with each respective gaming machine 100. In the form of the invention shown in FIG. 4A these two components, game server 302 and the game client components 303 combine to implement a game control arrangement which will be described in detail below. System 300 also includes an award controller 305, which is shown in FIG. 4A as being associated with game server 302 to indicate that the two components may be implemented through a common data processing device/computer system. Gaming machines 100, game server 302, and award controller 305 are connected in a network communication arrangement including first and second network switches 306 and 307, connected together through various wired or wireless signal paths, all shown as communications links 308 in FIG. 4A.

Each gaming machine 100, and particularly player interface 301, associated with each gaming machine, allows a player to make any inputs that may be required to make the respective gaming machine eligible for a prize-first bonus round. Player interface 301 also allows a player at the gaming machine to initiate plays in a primary game available through the gaming machine in some implementations. The respective video display device 107 associated with each respective gaming machine 100 is used according to the invention to generate the graphic displays to show the various elements of a prize-first bonus round at the respective gaming machine.

The game control arrangement made up of game server 302 and the respective game client 303 at a given gaming machine functions to control the respective video display device 107 for that gaming machine to display the base and bonus outcomes as described above. Award controller 305 is responsible for awarding prizes for a player's participation in the base game and prize-first bonus round and maintaining progressive prize information where the game also offers one or more progressive prizes. The network arrangement made up of network switches 306 and 307, and the various communications links 308 shown in FIG. 4A is illustrated merely as an example of a suitable communications arrangement. It should be noted that the game control arrangement, or as it is referred to generally the "game controller," may be implemented in some embodiments entirely on the gaming machine. This is especially true in jurisdictions that allow Class III gaming conducted with random number generators at each gaming machine. The present invention is not limited to any particular communications arrangement for facilitating communications between game server 302 and various gaming machines 100. Any wired or wireless communication arrangement employing any suitable communications protocols (such as TCP/IP for example) may be used in an apparatus according to the invention.

FIG. 4A shows other server(s) 310 included in the network. This illustrated "other server(s)" element 310 may include one or more data processing devices for performing various functions related to games conducted through system 300 and any other games that may be available to players through gaming machines 100. For example, apparatus 300 may be accounting servers providing support for cashless gaming or various forms of mixed cash/cashless gaming through the various gaming machines 100. In this example, an additional one of the other servers 310 will be included in apparatus 300 for supporting these types of wagering and payout systems. As another example, the various gaming machines 100 included in system 300 may allow players to participate in a game (primary game) other than the prize-first bonus round described herein, and this other game may rely on a result identified at or in cooperation with a device that is remote from the gaming machines. In this example, another server 310 may be included in the system for identifying results for the primary game and communicating those results to the various gaming machines 100 as necessary. Generally, the other server(s) 310 shown in FIG. 4A are shown only to indicate that numerous other components may be included along with the elements that participate in providing prize-first bonus rounds according to the present invention. Other server(s) 310 may provide record keeping, player tracking, accounting, result identifying services, or any other services that may be useful or necessary in a gaming system.

Referring to FIG. 4B, a block diagram of another example networked gaming system 400 associated with one or more gaming facilities is shown, including one or more networked gaming machines 100 in accordance with one or more embodiments. With reference to FIG. 4B, while a few servers have been shown separately, they may be combined or split into additional servers having additional capabilities.

As shown, networked gaming machines 100 (EGM1-EGM4) and one or more overhead displays 413 may be network connected and enable the content of one or more displays of gaming machines 100 to be mirrored or replayed on an overhead display 413. For example, the primary display content may be stored by the display controller or game processor 205 (shown in FIG. 3B) and transmitted through network controller 210 to the overhead display controller either substantially simultaneously or at a subsequent time according to either periodic programming executed by game processor 205 or a triggering event, such as a jackpot or large win, at a respective gaming machine 100. In the event that gaming machines 100 have cameras installed, the respective players' video images may be displayed on overhead display 413 along with the content of the player's display and any associated audio feed.

In one or more embodiments, game server 403 may provide server-based games and/or game services to network connected gaming devices, such as gaming machines 100 (which may be connected by network cable or wirelessly). Progressive server 407 may accumulate progressive awards by receiving defined amounts (such as a percentage of the wagers from eligible gaming devices or by receiving funding from marketing or casino funds) and provide progressive awards to winning gaming devices upon a progressive event, such as a progressive jackpot game outcome or other triggering event such as a random or pseudo-random win determination at a networked gaming device or server (such as to provide a large potential award to players playing the community feature game). Accounting server 411 may receive gaming data from each of the networked gaming devices, perform audit functions, and provide data for analysis programs, such as the IGT Mariposa program bundle.

Player account server 409 may maintain player account records, and store persistent player data such as accumulated player points and/or player preferences (e.g. game personalizing selections or options). For example, the player tracking display may be programmed to display a player menu that may include a choice of personalized gaming selections that may be applied to a gaming machine 100 being played by the player.

In one or more embodiments, the player menu may be programmed to display after a player inserts a player card into the card reader. When the card reader is inserted, an identification may be read from the card and transmitted to player account server 409. Player account server 409 transmits player information through network controller 210 to user interface 220 for display on the player tracking display. The player tracking display may provide a personalized welcome to the player, the player's current player points, and any additional personalized data. If the player has not previously made a selection, then this information may or may not be displayed. Once the player makes a personalizing selection, the information may be transmitted to game processor 205 for storing and use during the player's game play. Also, the player's selection may be transmitted to player account server 409 where it may be stored in association with the player's account for transmission to the player in future gaming sessions. The player may change selections at any time using the player tracking display (which may be touch sensitive or have player-selectable buttons associated with the various display selections).

In one or more embodiments, a gaming website may be accessible by players, e.g. gaming website 421, whereon one or more games may be displayed as described herein and played by a player such as through the use of personal computer 423 or handheld wireless device 425 (e.g. Blackberry cell phone, Apple iPhone, personal data assistant (PDA), iPad, etc.). To enter the website, a player may log in with a username (that may be associated with the player's account information stored on player account server 409 or be accessible by a casino operator to obtain player data and provide promotional offers), play various games on the website, make various personalizing selections, and save the information, so that during a next gaming session at a casino establishment, the player's playing data and personalized information may be associated with the player's account and accessible at the player's selected gaming machine 100.

Referring generally to the description herein, any use of ordinal terms such as "first," "second," "third," etc., to refer to an element does not by itself connote any priority, precedence, or order of one element over another, or the temporal order in which acts of a method are performed. Rather, unless specifically stated otherwise, such ordinal terms are used merely as labels to distinguish one element having a certain name from another element having a same name (but for use of the ordinal term).

Further, as described herein, various features have been provided in the context of various described embodiments, but may be used in other embodiments. The combinations of features described herein should not be interpreted to be limiting, and the features herein may be used in any working combination or sub-combination according to the invention. This description should therefore be interpreted as providing written support, under U.S. patent law and any relevant foreign patent laws, for any working combination or some sub-combination of the features herein.

The above described preferred embodiments are intended to illustrate the principles of the invention, but not to limit the scope of the invention. Various other embodiments and modifications to these preferred embodiments may be made by those skilled in the art without departing from the scope of the present invention.

The invention claimed is:

1. A method of providing a wagering game on an electronic gaming machine, the method comprising:

(a) via an acceptor of the electronic gaming machine, accepting a physical item associated with a monetary value;

(b) on an electronic display of the electronic gaming machine, showing a plurality of simulated reels having symbols thereon;

(c) linking each of the simulated reels to be controlled by a respective associated random number generation determined by a game processor associated with the electronic gaming machine;

(d) in response to receiving a player game activation, conducting a base game round in which each of the simulated reels is controlled by its respective linked random number generation in a reels-first manner to spin and stop under control of the game processor to produce a base game result;

(e) determining according to a base game paytable whether a non-zero prize amount is won in the base game round; and (f) when it is determined that the non-zero prize amount is won in the base game round, the game processor:

(i) using the prize amount from the base game round to select one of a plurality of bonus game distributions each having a plurality of outcome entries, each outcome entry having a bonus game prize amount which may be zero or non-zero, with a designated statistical distribution of occurring, each bonus game distribution having a different statistical distribution;

(ii) generating an additional random number and using the additional random number to produce the bonus game prize amount from the selected bonus game distribution;

(iii) determining if the bonus game prize amount is non-zero; and (iv) when it is determined that the bonus game prize amount is non-zero, providing a prize-first free spin bonus round including the following:

(I) using the bonus game prize amount to select a display control script from a set of display control scripts, (II) unlinking the simulated reels from control by their respective random number generation and then linking the simulated reels to a script execution module, and (III) executing the selected display control script with the script execution module to control the simulated reels to spin and stop a plurality of times according to data in the display control script, each stop providing a portion of the bonus game prize amount as a prize.

2. The method of claim 1, wherein providing the prize-first free spin bonus round is conducted as a mystery bonus having no visual indication to a player at the electronic gaming machine as to why the prize-first free spin bonus round occurred.

3. The method of claim 2, wherein the selected display control script is comprised of a data structure including reel stop data and prize amount data for multiple spins.

4. The method of claim 1, further comprising providing a separate set of multiple display control scripts to implement each possible bonus game prize amount, and wherein selecting the display control script is done using the bonus game prize amount to select a set of display control scripts, and making a random selection from the selected set.

5. The method of claim 4, wherein within each set of display control scripts, there are scripts with data producing different numbers of free spins in the prize-first free spin bonus round.

6. A method of providing a wagering game on an electronic gaming machine, the method comprising:

(a) via an acceptor of the electronic gaming machine, accepting a physical item associated with a monetary value;

(b) providing a plurality of slot machine reels on the electronic gaming machine, which are mechanical or simulated on an electronic display, each reel having symbols thereon;

(c) in response to receiving a player game activation, conducting a base game round in which each of the slot machine reels is simulated in a reels-first manner to spin and stop as determined randomly by a game processor to produce a base game result; and (d) determining according to a base game paytable whether there is a base game prize, and if so, entering a prize-first bonus round comprising:

(i) choosing a bonus round prize distribution by the game processor based on a size of the base game prize;

(ii) randomly selecting a bonus outcome by the game processor from the bonus round prize distribution;

(iii) if the bonus outcome has a zero award, ending the prize-first bonus round without displaying any indication that further gaming activity was conducted after the base game round spin and stop; and (iv) if the bonus outcome has a non-zero award, sequentially displaying a plurality of prize-first free spins of the reels under control of the game processor, each resulting in a portion of the non-zero award being awarded, and stopping when the entire amount of the non-zero award is awarded.

7. The method of claim 6, wherein sequentially displaying a plurality of free spins of the reels further comprises breaking down the non-zero award to divide among the plurality of free spins based at least in part on a random determination.

8. The method of claim 6, wherein sequentially displaying a plurality of free spins of the reels further comprises breaking down the non-zero award to divide among the plurality of free spins based on a predetermined breakdown dataset chosen from a set of predetermined breakdown datasets.

9. The method of claim 8, further comprising providing a set of predetermined breakdown datasets for each possible non-zero award in the prize-first bonus round.

10. The method of claim 9, wherein each predetermined breakdown dataset further includes reel stop data indicating a stop position for each reel in each free spin.

11. The method of claim 6, wherein the prize-first bonus round is conducted as a mystery bonus having no visual indication to a player at the electronic gaming machine as to why the prize-first bonus round occurred.

12. A program product comprising one or more tangible, non-transitory computer readable media storing program code, the program code being executable by a game processor associated with a gaming machine for:

(a) controlling an acceptor of the gaming machine, the acceptor being operable for accepting a physical item associated with a monetary value;

(b) controlling a plurality of slot machine reels at the gaming machine, which are mechanical or simulated on an electronic display, each reel having symbols thereon;

(c) in response to receiving a player game activation at the gaming machine, conducting a base game round in which each of the slot machine reels is simulated in a reels-first manner to spin and stop to produce a base game result; and (d) determining according to a base game paytable whether there is a base game prize, and if so, entering a prize-first bonus round comprising:

(i) choosing a bonus round prize distribution based on a size of the base game prize;

(ii) randomly selecting a bonus outcome from the bonus round prize distribution;

(iii) when the bonus outcome has a zero award, ending the prize-first bonus round without displaying any indication that further gaming activity was conducted after the base game round spin and stop; and (iv) when the bonus outcome has a non-zero award, sequentially displaying a plurality of prize-first free spins of the reels, each resulting in a portion of the non-zero award being awarded, and stopping when the entire amount of the non-zero award is awarded.

13. The program product of claim 12, wherein sequentially displaying a plurality of free spins of the reels further comprises breaking down the non-zero award to divide among the plurality of prize-first free spins based at least in part on a random determination.

14. The program product of claim 12, wherein sequentially displaying a plurality of free spins of the reels further comprises breaking down the non-zero award to divide among the plurality of free spins based on a predetermined breakdown dataset chosen from a set of predetermined breakdown datasets.

15. The program product of claim 14, further comprising providing a set of predetermined breakdown datasets for each possible non-zero award in the prize-first bonus round.

16. The program product of claim 15, wherein each predetermined breakdown dataset further includes reel stop data indicating a stop position for each reel in each free spin.

17. The program product of claim 14, wherein within each set of predetermined breakdown datasets, there is data producing different numbers of free spins in the prize-first bonus round.

18. The program product of claim 12, wherein the prize-first bonus round is conducted as a mystery bonus having no visual indication to a player at the gaming machine as to why the prize-first bonus round occurred.

19. The program product of claim 12, in which game program code operable to obtain random numbers for the base game round is separate program code from bonus round program code operable to produce random numbers for random selections made in the bonus round.

* * * * *